US006011226A

United States Patent [19]

Sadowski et al.

[11] Patent Number: 6,011,226

[45] Date of Patent: Jan. 4, 2000

[54] ELASTOMERIC ROCKER SWITCH BEZEL

[75] Inventors: Walter A. Sadowski, Newington; Karen B. Kowalczyk, Southington, both of Conn.

[73] Assignee: Carlingswitch, Inc., Plainville, Conn.

[21] Appl. No.: 09/128,201

[22] Filed: Aug. 3, 1998

[51] Int. Cl.[7] ..... H01H 9/04

[52] U.S. Cl. ..... 200/302.3

[58] Field of Search ..... 200/6 R, 16 R, 200/553, 293, 302.1, 302.3, 333, 339, 5 R

[56] References Cited

U.S. PATENT DOCUMENTS

| | | | |
|---|---|---|---|
| 2,868,920 | 1/1959 | Mumford et al. | 200/87 |
| 3,654,416 | 4/1972 | Cherry et al. | 200/168 G |
| 3,668,938 | 6/1972 | Dimitry | 74/18.1 |
| 4,287,400 | 9/1981 | Kitik et al. | 200/302 |
| 5,343,007 | 8/1994 | Roeser et al. | 200/296 |
| 5,642,806 | 7/1997 | Karadimas | 200/557 |
| 5,662,213 | 9/1997 | Kattler et al. | 200/302.3 |

*Primary Examiner*—Michael Friedhofer

*Attorney, Agent, or Firm*—McCormick, Paulding & Huber LLP

[57] ABSTRACT

An elastomeric switch case bezel fits tightly around a flange in the housing and has an internal bead that engages the switch rocker to seal it as the rocker moves between limit positions.

3 Claims, 3 Drawing Sheets

ELASTOMERIC ROCKER SWITCH BEZEL

BACKGROUND OF THE INVENTION

This invention relates generally to sealing of a movable switch actuator in its housing, and deals more particularly with an elastomeric switch bezel for a rocker switch that is adapted to be secured to the top of the switch housing defining the rocker opening. The bezel includes a bead for engaging the side walls and end walls of the rocker so that the rocker is free to move relative to the bezel and the bead. However, the bead maintains a seal between the rocker and the switch housing.

SUMMARY OF THE INVENTION

In accordance with the present invention, the switch housing defines an upwardly open rocker opening and suitable means for pivotably supporting the rocker therein. The rocker is assembled with the housing preferably by means of complementary shaped openings and axle stubs, and the switch housing preferably includes a flange for receiving a marginal edge portion of the elastomeric bezel. The bezel surrounds the switch housing and includes a bead for engaging the side walls and end walls of the rocker.

The primary object of the invention is to protect the contacts and other components inside the switch housing from environmental damage due to moisture and other contaminants.

DETAILED DESCRIPTION OF THE DRAWINGS

Other features, aspects, and advantages of the present invention will become better understood with regard to the following description, appended claims, and accompanying drawings wherein:

DETAILED DESCRIPTION OF THE PREFERRED EMBODIMENT

Turning now to the drawings in greater detail, a rocker switch, according to the present invention, may be similar to that shown and described in prior U.S. Pat. No. 5,496,981 and assigned to the Assignee herein, which prior patent is incorporated by reference herein.

Figure 2:
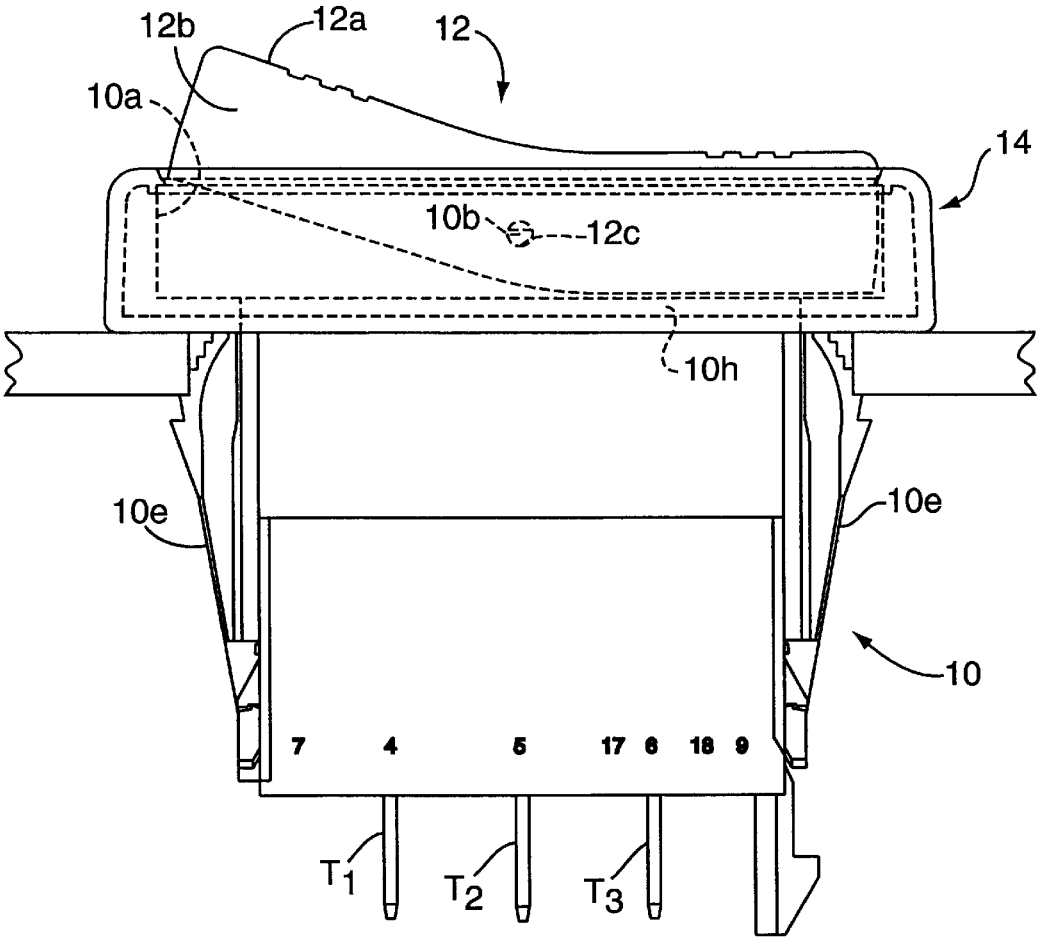
FIG. 2 is a side elevational view of the rocker switch illustrated in FIG. 1 together with its elastomeric bezel.

Such a rocker switch generally includes an upwardly open switch housing 10 and may include upper and lower portions joined together by a structure 10*e* that defines wings to engage the underside of a panel when the switch housing is to be mounted in a panel opening as suggested in FIG. 2 by the panel P. Alternatively, the wings 10*e* might also be formed directly on a unitary one-piece housing (not shown) such as described in another prior art U.S. Pat. No. 4,909,827, also incorporated by reference herein.

Figure 1:
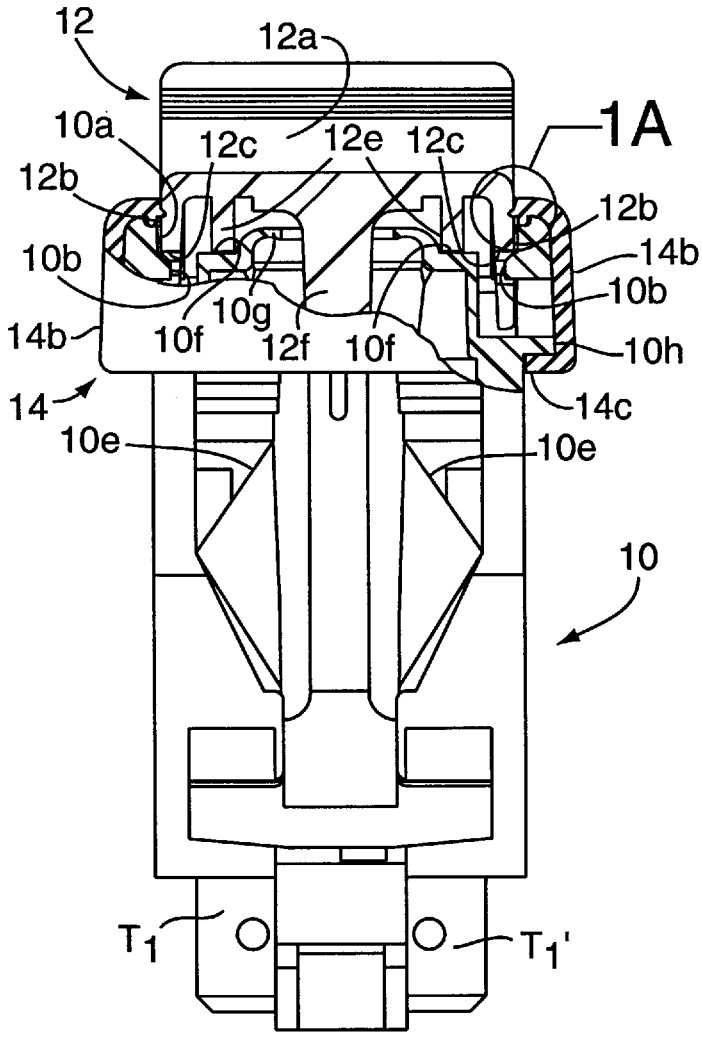
FIG. 1 is an end view with portions broken away to reveal the cross-sectional configuration of the elastomeric bezel, and its interaction with both the rocker side wall and a flange provided in the switch housing.
Figure 4:
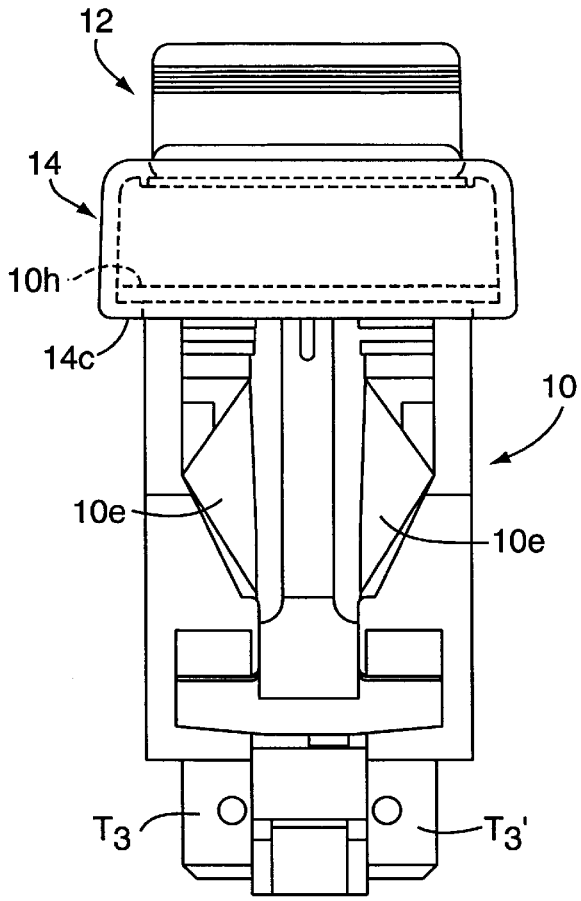
FIG. 4 is an end view without portions broken away as illustrated in FIG. 1.

Typically, such a switch housing includes a plurality of fixed contacts which are provided in the lower wall of the housing and electrically connected to or integrally formed with terminals, such as those indicated at $T_1$, $T_2$ and $T_3$ in FIGS. 1, 2 and 4. As suggested in FIGS. 1 and 4, two such sets of terminals are provided in the double pole style switch illustrated, the second bank or set of terminals being illustrated at $T'_1$ through $T'_3$.

Figure 1A:
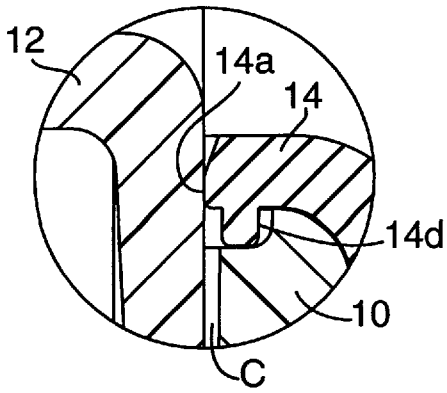
FIG. 1A is an enlarged view of the relevant portion of FIG. 1.
Figure 3:
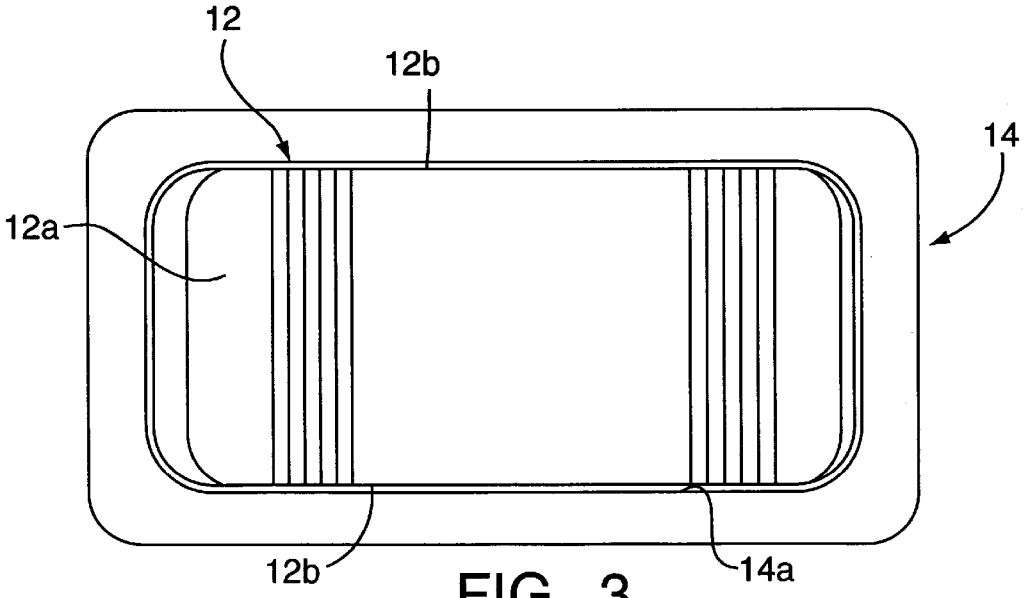
FIG. 3 is a top plan view thereof.

As shown in the above-mentioned patents, a rocker 12 is pivotably supported in the switch housing, and more particularly in a rocker opening 10*a* provided in the housing for this purpose. Typically, such a rocker 12 may be supported by axle defining portions cooperating with openings in one of the other of these two components, and as suggested in FIG. 1, axle defining stubs 10*b* are defined in the side walls of the switch housing 10 for entry in openings 12*c* provided for this purpose in depending side walls or skirts of the rocker 12. The rocker 12 has a concave top wall 12*a* integrally formed with these depending side walls 12*b* and with integrally defined end walls to provide a generally rectangularly shaped rocker 12, as best shown in FIG. 3. However, the corners of the rectangular rocker 12 are rounded to facilitate assembly with an elastomeric bezel that defines an internal shape and size such that it is snugly fitted to that of the external contour for the rocker 12. More particularly, and as best shown in FIG. 1A, the bezel 14 defines a bead 14*a* that engages the side walls and the end walls of the rocker 12 for purposes of sealing the clearance C provided between the rocker 12 and the housing 10, as but shown in FIG. 1A.

FIG. 1 shows the rocker 12 as including a depending integrally formed post 12*f* that is used to connect or couple the rocker to the internal movable components of the switch, namely: a movable contact or an associated plunger that in turn engages such a movable contact. The reader is referred to either one of the above-mentioned prior U.S. patents for a more detailed description of the internal workings of these components of the rocker switch.

The rocker 12 also includes depending tabs 12*e* that are adapted to abut shoulders 10*f* provided for this purpose in the switch housing 10 in order to aid in the pivotable support of the rocker 12 in the switch housing 10. The switch housing 10 includes an integrally formed bridge portion 10*g* that defines the shoulders and serves to interconnect the switch housing side walls in the region of the pivotable support for the rocker 12 and increase the rigidity of the resulting structure. The plunger portion 12*f* of the rocker 12 is freely received in an opening provided for this purpose in the bridge 10*g* so as to avoid any interference between the rocker and housing during rocker movement between its limit positions (one of which positions in shown in FIG. 2).

Figure 5:
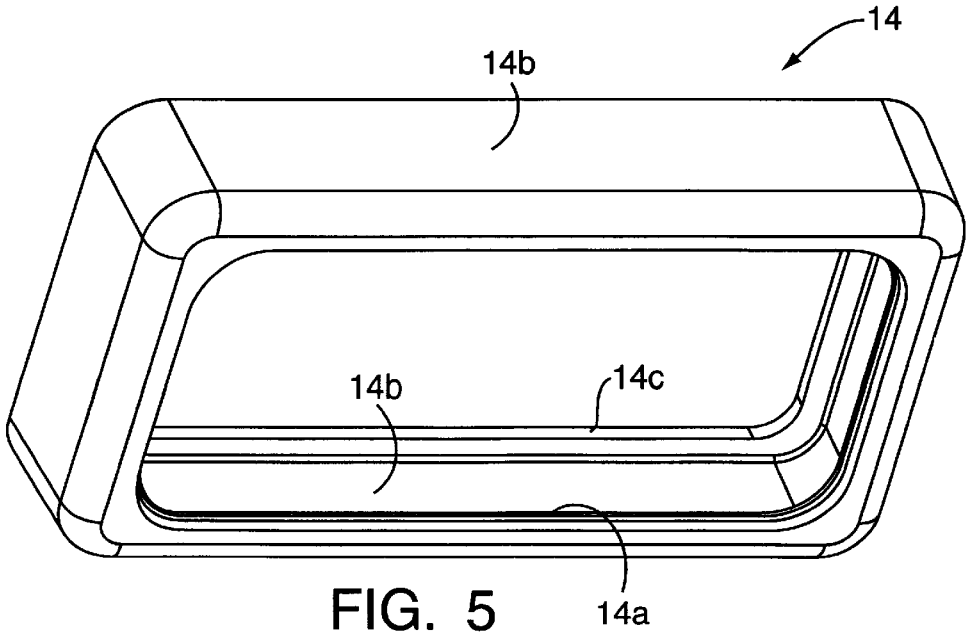
FIG. 5 is a perspective view of the elastomeric bezel.

With further reference to the elastomeric bezel 14, and as best shown in FIG. 5, the bezel 14 includes side skirt portions 14*b* that are snugly received against the side walls of the housing that define the rocker opening. The skirt portions 14*b* of bezel 14 include an inwardly formed flange 14*c* that is stretched over and around a peripherally extending flange 10*h* of the housing as shown in FIG. 1. This flange 10*h* is also shown by the broken lines in FIGS. 2 and 3. The depending skirt 14*b* of the elastomeric bezel 14 extends around the entire bezel and the integrally formed inturned flange 14*c* on its lower marginal edge serves to anchor the bezel to the housing in a stretched condition. This flange or seal is preferably trapped between the bracket 10 and a panel (not shown) in which the switch is mounted. The bead 14*a*, best shown in FIG. 1A, extends around the bezel to seal the clearance provided between the housing 10 and the rocker 12 as mentioned previously. A second bead 14*d* anchors the top of bezel 14 to the bracket 10, as best shown in FIG. 1A.

What is claimed is:

1. A rocker switch comprising a housing having a generally rectangular outline, said housing defining a generally rectangular rocker opening, a generally rectangular rocker pivotably supported in said rocker opening for movement between limit positions such that side and end walls of the rocker remain in close proximity to said rocker opening during said movement and provide only a clearance space therebetween, said elastomeric bezel having an internal bead for engaging said rocker side walls and end walls to seal off the clearance space between said rocker and said housing.

2. The switch according to claim 1, wherein said housing outline is defined by an external flange around said rocker opening, and said bezel defining an internal flange for engaging said external flange to hold said elastomeric bezel onto said housing external flange.

3. The switch according to claim 1, wherein said elastomeric bezel has a size and shape requiring that it be stretched to be so fitted around said housing, and said bezel defining an opening for snugly receiving said rocker and a skirt portion snugly received on said housing.

* * * * *